United States Patent [19]

Sane et al.

[11] Patent Number: 4,560,448

[45] Date of Patent: Dec. 24, 1985

[54] ALUMINUM WETTABLE MATERIALS FOR ALUMINUM PRODUCTION

[75] Inventors: Ajit Y. Sane, Willoughby; Douglas J. Wheeler, Cleveland Heights, both of Ohio; Charles S. Kuivila, Evanston, Ill.

[73] Assignee: Eltech Systems Corporation, Boca Raton, Fla.

[21] Appl. No.: 505,363

[22] Filed: Jun. 17, 1983

Related U.S. Application Data

[63] Continuation-in-part of Ser. No. 376,629, May 10, 1982, abandoned.

[51] Int. Cl.[4] ..... C25C 3/06; C25C 3/08; C25C 7/00; B05D 3/00

[52] U.S. Cl. ..... 204/67; 204/279; 204/290 R; 204/291; 427/431

[58] Field of Search ..... 204/67, 243 R, 287, 204/290 R, 39, 245, 291, 279; 427/431

[56] References Cited

U.S. PATENT DOCUMENTS

| | | | |
|---|---|---|---|
| 3,428,545 | 2/1969 | Johnson | 204/243 R |
| 3,471,380 | 10/1969 | Bullough | 204/67 |
| 3,827,954 | 8/1974 | McCawley | 204/39 |
| 3,829,374 | 8/1974 | Kugler et al. | 204/290 R |
| 4,308,115 | 12/1981 | Foster, Jr. et al. | 204/67 |
| 4,462,886 | 7/1984 | Kugler | 204/291 X |

FOREIGN PATENT DOCUMENTS 0021850 1/1981 European Pat. Off. .

*Primary Examiner*—Donald R. Valentine
*Attorney, Agent, or Firm*—Arthur S. Collins

[57] ABSTRACT

A method for rendering an aluminum electrowinning cell component fabricated from an aluminum nonwettable material wettable by molten aluminum, and therefore utilizable within the cell. Under the method, the component is coated with titanium and boron, and while the component is immersed in molten aluminum within the cell, the molten aluminum is maintained near saturation with boron and titanium.

26 Claims, 1 Drawing Figure

ALUMINUM WETTABLE MATERIALS FOR ALUMINUM PRODUCTION

This is a continuation in part of application Ser. No. 376,629, filed May 10, 1982 now abandoned.

TECHNICAL FIELD OF THE INVENTION

This invention relates to electrolytic cells for the electrowinning of molten aluminum from alumina dissolved in molten cryolite contained within the cell. More specifically this invention relates to components immersed in molten aluminum within the cell, and where these components are fabricated from a material substantially non wettable by the molten aluminum, to methods for making these components aluminum wettable.

BACKGROUND OF THE INVENTION

Aluminum is commonly produced by electrowinning aluminum from $Al_2O_3$ (alumina) at about 900° C. to 1,000° C. Aluminum oxide raw material frequently is dissolved in molten $Na_3AlF_6$ (cryolite) that generally contains other additives helpful to the electrowinning process such as $CaF_2$, $AlF_3$ and possibly LiF or $MgF_2$.

In one popular configuration of these electrolytic aluminum cells, anode and cathode are arranged in vertically spaced configuration within the cell, the anode being uppermost. Reduction of aluminum oxide to aluminum occurs at the cathode which customarily is positioned at the bottom or floor of the cell. Oxygen is dissociated from $Al_2O_3$, in most commercial cells combining with carbonacious material comprising the cell anode and being emitted from the cell as CO and $CO_2$.

Cryolite is an aggressive chemical necessitating use of a cathode material substantially resistant to this aggressive cryolite. One popular choice is the use of molten aluminum as a cathode. While use of other cathodes such as bare graphite in contact with cryolite has been contemplated, formation of undesirable by-products such as aluminum carbide has discouraged use. In many commercial cells, the cathode often covers substantially the entire floor of the cell which typically can be 6 feet wide by 18 or more feet in length.

In utilizing aluminum for cathode purposes in a cell, typically the cathode is included in an assembly of a cathodic current feeder covered by a pool of aluminum ranging in depth, depending upon the cell, from a few inches to in excess of a foot, but generally about 6 inches. The aluminum pool functions effectively as a cathode and also serves to protect current feeders made from materials less than fully resistant to cell contents.

These aluminum pool type cell cathode assemblies contain conductive current collectors. Where these conductive current collectors are utilized in certain cell configurations, these collectors contribute to an electrical current flow within the cell that is not perpendicular to the cell bottom. These nonperpendicular electrical currents can interact with strong magnetic fields established around cells by current flow through busses and the like to contribute to strong electromagnetic fluxes within the cell.

In cells employing a pool of aluminum covering the cathode floor of the cell, the cryolite, containing $Al_2O_3$ to be electrolyzed floats atop this aluminum pool. The cell anodes are immersed in this cryolite layer.

It is important that these anodes do not contact the aluminum pool for such contact would result in a somewhat disfunctional short circuit within the cell. The electromagnetic flux within the cell arising from the interaction of nonperpendicular electrical currents with an electromagnetic field surrounding the cell contributes to the formation of wave motion within the aluminum pool contained in the cell, making prediction of the exact depth of the aluminum pool somewhat imprecise. Therefore, prediction of the minimum necessary spacing between the anode and cathode current feeder and between the anode and the interface between molten aluminum and molten cryolite at any particular cell location is somewhat imprecise. Consequentially, cell anodes are generally positioned within the cryolite substantially above the normal or expected level of the interface between molten cryolite and molten aluminum within the cell. Usually, a spacing of $1\frac{1}{2}$ to $2\frac{1}{2}$ inches is utilized.

The combination of a substantial aluminum pool depth susceptible to wave motion and a positioning of the anodes substantially above the cryolite-aluminum normal interface position to forestall short circuits caused, for example, by wave motion in the aluminum establishes a substantial gap between the anode and cathode in most conventional cells. Electrical power consumed in operation of the cell is somewhat proportional to the magnitude of this gap. Substantial reductions in the anode-cathode spacing would result in considerable cost savings via reduced cell electrical power consumption during operation. Additionally, where the thickness of aluminum in the pool could be reduced while reliably maintaining a molten aluminum cover upon the cathodic current feeder, considerable aluminum inventory savings would be realized.

One proposal to reduce spacing between anode and cathode has been to employ so-called "drained cathodes" in constructing aluminum electrolysis cells. In such cells, no pool of aluminum is maintained upon a cathode current feeder to function as a cathode; electrowon aluminum drains from the cathode at the bottom of the cell to be recovered from a collection area. In drained cathode cells, without wave action attendant to a molten aluminum pool, the anode and the cathode may be quite closely arranged, realizing significant electrical power savings.

In these drained cathode cells, the cathode, particularly where non-wettable by molten aluminum, is in generally continuous contact with molten cryolite. This aggressive material, in contact with a graphite or carbon cathode, can contribute to material loss from the cathode and can trigger formation of such undesirables as aluminum carbide. Particularly carbon or graphite for use as a drained cathode material of construction is therefore of quite limited utility due to possible service life constraints and carbide contaminant formation.

Other longer lived materials are, in theory, available for use in a drained cathode. Generally, these materials are both conductive and aluminum wettable refractory materials such as $TiB_2$. It has been found that unless $TiB_2$ and similar materials are in essentially pure form, they too lose material or corrode at unacceptable rates in the aggressive cell environment.

It is believed that the molten cryolite can contribute to $TiB_2$ corrosion by fluxing reaction products at a reaction between impure $TiB_2$ and aluminum, particularly near grain boundaries of the material. While it is known that aluminum electrowinning cells utilizing essentially pure $TiB_2$ do not exhibit as substantial a corrosion susceptibility as do those employing lower purity $TiB_2$, cost and availability factors seriously limit the use of $TiB_2$ sufficiently pure to withstand an aggressive aluminum cell environment.

In another proposal, a particular cathodic current feeder configuration has been utilized to reduce significantly non-perpendicular current flow within the cell, thereby reducing wave motion. These solutions have not proven wholly satisfactory however.

Conventionally, most cells employ construction materials that are either wettable by molten aluminum, are relatively inert to the corrosive effects of cryolite or both. Where a substance is not readily wetted by molten aluminum, even though immersed in molten aluminum the substance may contact cryolite present at the interface between the substance and the molten aluminum due to poor wetting. Where the substance is significantly soluble in cryolite, or corroded by cryolite, substantial material losses to the substrate therefore can occur.

However, substrates substantially wettable by molten aluminum tend, while immersed in the molten aluminum, to be protected from the deleterious effects of contact with molten cryolite. A sheathing effect by the molten aluminum protects the substance.

Aluminum wettable substances such as refractory $TiB_2$ have therefore been suggested for constructing components of cells which are to be immersed in molten aluminum. Conversely it has been found relatively less acceptable to employ aluminum nonwettable materials, particularly those such as alumina which are subject to attack/dissolution by molten cryolite, for fabrication of cell components. This reluctance may be enhanced where dimensional stability of the component is relatively important, for example in the fabrication of electrical current feeders, weirs, sidewalls, and the like.

Were techniques available for rendering aluminum nonwettable substrates wettable by molten aluminum, these structures could then be utilized within aluminum electrowinning cells, immersed in molten aluminum contained in the cell to preclude attack/dissolution by molten cryolite present in the cell. Where these normally nonwettable substrates are relatively inexpensive, their potential use in the electrolytic cell becomes quite attractive.

DISCLOSURE OF THE INVENTION

The present invention provides a method for making substrates used in, or components of an aluminum electrowinning cell substantially wettable and thereby at least partially filled if porous by molten aluminum where those components or substrates normally would not be aluminum wetted in the environment of the cell. Used in the electrowinning cell, these wettable components, when immersed in molten aluminum contained in the cell are stable in the cell environment even where the materials from which the substrates were fabricated would otherwise be subject to aggressive attack by materials such as cryolite contained in the cell.

Substrates are made wettable by molten aluminum by applying to the substrate a coating of wetting agent and a solubility suppressor prior to or while the substrate is immersed in molten aluminum, and molten aluminum is maintained near saturation with the wetting agent and solubility suppressor by introducing the wetting agent and the solubility suppressor into the molten aluminum to maintain desired levels in the molten aluminum.

The coating of wetting agent and solubility suppressor applied to the substrate is preferably quite thin. The coating need not be continuous.

The method preferably is utilized to make refractory materials commonly non aluminum wettable, amenable to wetting by aluminum. Once aluminum wettable, these refractory materials can be utilized for a variety of purposes within an aluminum electrowinning cell including weirs, current feeders, packing, baffles, structural components and the like.

The above and other features and advantages of the invention will be more apparent from the description of the preferred embodiment when considered in conjunction with the accompanying drawings forming a part of the specification.

DESCRIPTION OF THE DRAWINGS

The FIGURE is a cross sectional representation of an aluminum electrowinning cell.

BEST EMBODIMENTS OF THE INVENTION

Figure 1:
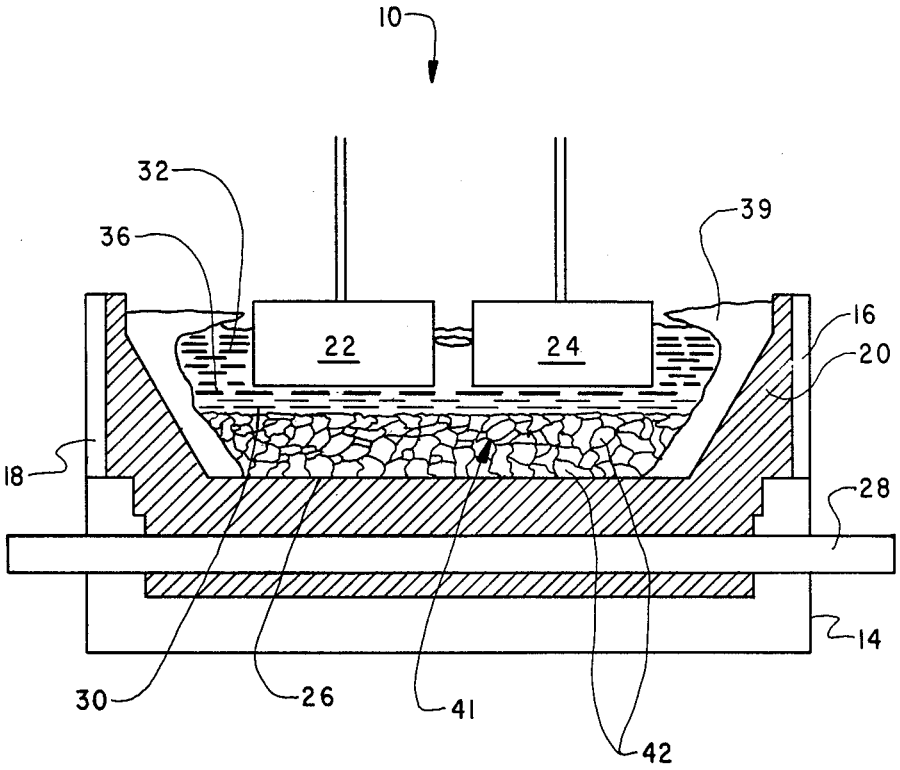

Referring to the drawings, the FIGURE shows in cross section a representation of an aluminum electrowinning cell 10. The cell includes a base 14 and sidewalls 16, 18, generally of steel, surrounding the cell. The cell includes a cathodic current feeder 20 and anodes 22, 24.

The base and sidewalls enclose the cathodic current feeder 20 which in this best embodiment functions also as a cell liner. Portions 26 of the liner define a floor of the cell. Well known refractory materials and graphite are suitable for fabricating this current feeder 20, as are other suitable or conventional materials. A current buss 28, embedded in the feeder 20 provides electrical current for distribution within the cell 10. The buss 28 is connected to an external source of electrical current (not shown).

The anodes 22, 24 are arranged in vertically spaced relationship with the current feeder portions 26 defining the floor of the cell. The anodes 22, 24 are separated from the cathodic current feeder by two pools 30, 32 of molten material. One pool 30 comprises essentially molten aluminum. This molten aluminum pool functions as a cathode for electrowinning of aluminum within the cell. While the pool consists essentially of molten aluminum, impurities customarily associated with aluminum produced electrolytically may be present.

The remaining pool 32 is comprised of molten cryolite, $Na_3AlF_6$, containing dissolved $Al_2O_3$. A number of cryolite formulations that include additives such as $CaF_2$, LiF, and $AlF_3$ for enhancing electrolysis of the $Al_2O_3$ to aluminum are possible and are contemplated as being utilized within the scope of the invention. This cryolite layer, being less dense than the molten aluminum, floats thereupon, forming interface 36.

An insulating layer 39 is provided to resist heat flow from the cell 10. While a variety of well-known structures are available for making this insulating structure, often the insulating layer 39 is crystallized contents of the electrolytic cell.

The anodes 22, 24 are fabricated from any suitable or conventional material and immersed in a cryolite phase 32 contained in the cell. Since oxygen is released in some form at the anode, the anode material must be either resistant to attack by oxygen or should be made of a material that can be agreeably reacted with the evolving oxygen, preferably producing a lower anode half cell voltage by virtue of reactive depolarization.

Typically, carbon or graphite is utilized providing a depolarized anode. The anodes 22, 24 should be arranged for vertical movement within the cell so that a desired spacing can be maintained between each anode and cathode notwithstanding the anode being consumed by evolving oxygen.

In this best embodiment a packed bed 41 of loose elements 42 is positioned in the cell, in the molten aluminum pool 30. These elements are formed of a substance substantially non-wettable by aluminum. The elements are maintained in the molten aluminum at a level at or below the interface 36 between the molten aluminum and molten cryolite, the depth to which the elements are packed being substantially uniform across the cell. In general, the elements should be not further than 5 centimeters from the interface, but should not extend substantially above the interface, particularly where the elements 42 may be subject to aggressive attack by the cryolite.

The packed bed elements can be of any shape. It is preferred that the shapes provide, when packed, interstices through the packed bed whereby aluminum can fill gaps in the packing to maintain uniform electrical conductivity through the packed pool of aluminum. Particularly, packing in the formed of berl saddles, Raschig rings, Intalox saddles, and equiaxed shapes such as cylinders and spheres are much preferred; however randomly shaped packing, blocks or bricks may be utilized.

The packing is fabricated from a material substantially non-wettable by molten aluminum, preferably porous, with alumina, $Al_2O_3$, being much preferred. Since alumina is soluble in the molten cryolite, and since aluminum is being electrolyzed within the cell from alumina dissolved in the cryolite layer 32, it is important that the alumina packing be maintained reliably covered with aluminum to prevent consumption of the packing. This covering is conveniently accomplished by maintaining the packing virtually continuously beneath the interface; when the packing is non-wettable by aluminum, a substantial aluminum thickness is required to assure non-contact with cryolite. However should portions of the aluminum, non-wettable packing protrude from the molten aluminum pool but be coated with molten aluminum, the packing would thereby be protected. Being coated by molten aluminum shields the packing elements from aggressive attack by the cryolite.

Shielding can be accomplished by making the normally aluminum non-wettable packing wettable by molten aluminum at operating temperatures within the cell. Wettability is accomplished by providing the otherwise nonwettable packing with a surface coating of a wetting agent and a solubility suppressor for the wetting agent. This coating can include any of a variety of elemental materials known for making aluminum non-wettable materials wettable by aluminum. As wetting agent Zr, Hf, Si, Mg, V, Cr, Nb, Ca and Ti are suitable with Ti being substantially preferred in the practice of the invention.

Elements substantially suppressing the solubility of the wetting agents in molten aluminum are suitable for use as solubility suppressors. Typically boron, carbon and nitrogen are useful with boron being much preferred. In this best embodiment the coating applied then is $TiB_2$, but the practice detailed applies equally to other wetting agents and solubility suppressors.

The surface coating can be applied to the packing by a variety of methods. For example the packing can be soaked in a slurry of titanium hydride and amorphous, powdered boron in polyvinyl alcohol, and then fired at 800°–1500° C. for 1 to 25 hours.

Alternatively titanium can be applied by electroless metallidization techniques in a fused salt bath. The titanium coated packing is then packed in boron powder for 1 to 25 hours at 800° to 1200° C. As an alternate to electroless metalliding, the titanium may be sputtered onto the packing. In lieu of the sputtering of titanium onto the packing, boridization in boron powder may be eliminated by sputtering $TiB_2$ directly onto the packing.

$TiB_2$ may also be applied directly to the packing by vapor deposition. Alternately a slurry of $TiO_2$ and $B_2O_3$ may be spray applied to the surface and reduced.

The packing can be soaked in aluminum containing titanium and boron for 1 to 2 weeks to apply the coating. Titanium may be present as Ti, $TiO_2$ or $TiB_2$ for example. Where boron may be present as $B_2O_3$,$B^o$ for example where the packing has been molded from a refractory material such as alumina, titanium and boron compounds such as $TiO_2$ and $B_2O_3$ or $TiB_2$ may be molded with the packing. Upon heating, the boron and titanium will tend to migrate to the surface of the packing to provide the desired coating. Wetting of alumina or other suitable substrate can be achieved using this procedure of soaking in aluminum containing wetting agent and solubility suppressor outside of the aluminum electrowinning cell, in which case the coated wettable packing is transferred to the cell. Alternatively, the packing or substrate can be made wettable in-situ by soaking in aluminum containing wetting agent and solubility suppressor in the aluminum electrowinning cell.

The coating can be produced in-situ through the aluminothermic reduction of titanium oxide and boron oxide coatings on alumina or other substrates. The formation of a surface coating of $TiB_2$ combined with alumina results through this in-situ reaction and wettability by aluminum is achieved. If desired, this in-situ reaction coating can be done by contact with molten aluminum in the electrowinning cell.

An average coating thickness of between 5.0 angstroms and 100 microns is preferable, with coatings in excess of about 10 angstroms being much preferred. The coating need not be continuous; continuous coatings delivering only marginally superior wettability over noncontinuous coatings.

It should be noted that the inclusion of the wetting agent and solubility suppressor is intended to produce a surface effect only. Total inclusion of substances such as $TiB_2$ generally will not exceed about 5% and usually substantially below 1% by weight. Unless the substrate being coated is electrically conductive, the coated substrate remains relatively electrically non-conductive.

It is believed that the $TiB_2$ coating permits virtually instantaneous wetting of the substrate. It is further believed that the $TiB_2$ coating functions to provide a surfactant permitting molten aluminum to penetrate pores of a coated structure. A partially aluminum filled porous structure surface results, having advantageous physical characteristics over a mere wetted surface. Ti and B dissolving from the surface coating penetrate the pores with the molten aluminum, permitting in surfactant fashion the passage of molten aluminum into pores otherwise inaccessible to the molten aluminum by reason of surface tension. To achieve this result, both the substrate surface and the $TiB_2$ coating should be porous, permitting infiltration into substrate pores.

Titanium and boron present in the coating are, together, marginally soluble in molten aluminum. Once immersed in molten aluminum, the coating therefore tends to dissolve into the molten aluminum unless the molten aluminum is near or above saturation with titanium and boron. At operating temperatures for an aluminum electrowinning cell, titanium is soluble in molten aluminum to about 50 parts per million (ppm) and boron to about 20 ppm. Therefore it is desirable that molten aluminum present in the cell be maintained saturated with titanium and boron by the addition of compounds containing them. Typically, existing aluminum electrowinning cells are equipped for introducing additives, however any suitable or conventional method for introducing the Ti and B would suffice, including the introduction of $TiB_2$.

At the interface between molten aluminum and the coated substrate, a quite elevated concentration of titanium exists. This concentration decreases exponentially with distance into the substrate.

There is an affinity between molten cryolite and titanium and boron that might lead to the conclusion that titanium and boron present in the molten aluminum layer 30 within the cell 10 may lead to inclusion of titanium and boron in the molten cryolite layer 32 thereby gradually stripping the applied boron and titanium from the packing 42 particularly where cryolite is replaced from time to time. However, while the cell 10 is under an electrical potential such as during aluminum electrowinning, it has been found that the cryolite does not tend to retain the titanium and boron present in the cell, much of these materials accumulating in excess of solubility as deposits within the aluminum phase 30.

While in this preferred embodiment, packing has been shown as the cell component being fabricated from a nonaluminum wettable material, other components are suitable candidates for fabrication using these wettability techniques. For example, weirs for overflowing molten aluminum from the cell, and current feeders may be fabricated using the technique of the instant invention from aluminum nonwettable materials. Other applications within the cell will become apparent upon reflection.

A number of suitable or conventional materials substantially nonwettable by aluminum are available for use in the instant invention. These materials, because of the relatively elevated temperature they must withstand in an aluminum electrolysis cell, are primarily refractory materials including alumina, aluminum nitride, AlON, SiAlON, boron nitride, silicon nitride, aluminum borides such as $AlB_{12}$, silicon carbides, alkali earth metal zirconates and aluminates such as calcium zirconate, barium zirconate, and magnesium aluminate, and mixtures of these materials. Alumina is preferred.

Boron, within the purview of this invention appears to function to suppress the solubility of titanium in the molten aluminum. Therefore it should be apparent that substrates such as the packing, coated solely with titanium, and immersed in molten aluminum will be initially wetted by the aluminum. However, in the absence of boron within the system, this titanium coating will be relatively readily removed from the substrate surface and solubilized in the molten aluminum. In the presence of boron in the molten aluminum, this titanium coating is relatively rapidly transformed to a titanium and boron coating, while suppressing Ti solubility in the aluminum, the coating being stable while the aluminum within the cell remains near saturation with titanium and boron.

By wettable, what is meant is a contact angle between the coated substrate and molten aluminum of less than 90°; nonwettable being a contact angle in excess of 90°. Generally otherwise nonwettable substrates such as alumina, coated according to the method of the instant invention allow aluminum to spread over the substrate surface, indicating a contact angle of about 30° or less. Utilizing the techniques of the instant invention, an alumina substrate, normally subject to some aggressive attack by molten cryolite even when immersed in an aluminum pool within an aluminum electrowinning cell, can be coated and immersed in molten aluminum within the cell with small concern for its dimensional integrity.

The following examples are offered to further illustrate the invention.

EXAMPLE 1

Titanium diboride was coated onto Diamonite alumina balls. These balls were supplied by Diamonite Products Manufacturing Incorporated and were comprised of approximately 1 to 3 percent silicon dioxide and the balance alumina. These balls were first etched in a molten salt mixture of 49 percent NaOH, 49 percent KOH, and 2 percent NaF at 180° C. for approximately 1 hour. Following etching, these balls were solvent degreased and coated with titanium by immersion in a molten salt mixture of 203.6 grams of KCl, 165.2 grams of NaCl, 15.2 grams of $CaCl_2$ and 16.7 grams of $TiH_2$. Coating was conducted at approximately 1000° C. for four hours.

The balls were then washed and dried. Following drying the balls were packed into a boron powder bed and boridized using well known techniques at 1000° C. for 48 hours in an argon atmosphere scrubbed of residual oxygen by passage over hot titanium. Following boridization, the balls were placed in a ball mill including alumina beads and agitated to remove excess surface boron from the balls by abrasion.

All of the titanium diboride coated samples showed good surface conductivity and titanium diboride adhesion.

The balls were then each placed in an alumina crucible with 30 grams of aluminum and 3–5 grams cryolite. The crucible was evacuated and heated to 1000° C. for 4–8 weeks. While under heat the crucible was maintained under an argon purge, the argon being scrubbed of oxygen by passage over hot titanium at 800°–900° C.

Removed from the crucible, the balls were inspected and found to be wetted by aluminum. Only extremely limited grain boundary corrosion was noted in a $TiB_2$ coating that averaged only 10–20 micrometers in thickness. Additionally, trace amounts of titanium were found in the alumina crucible, primarily in the pores. These pores were also found to be at least partially wetted by aluminum with a small quantity of the aluminum being found in pores of the alumina crucible. Specifically with respect to the balls, the interface between the $TiB_2$ coating and the alumina substrate was found to be intact, and no evidence of grain boundary corrosion of $TiB_2$ was observed. In the balls, a contrast gradation was observed in the alumina substrate which was attributed to filling of the pores with aluminum. Infiltration of pores within $Al_2O_3$ balls by aluminum was made possible by increasing the wettability of $Al_2O_3$. The coating it is believed acted as a source of surfactants. It is important to recognize that coating permits instantaneous wetting of the surface but the action of the surfactants results in aluminum infiltration of pores.

EXAMPLE 2

Example 1 was repeated with the exception that the balls were not solvent degreased. The results were essentially identical.

EXAMPLE 3

The following alumina objects were etched for 15 minutes at 300° C. in a mixture of 392 grams of NaOH, 392 grams of KOH, and 16 grams of NaF:

cubes of alumina honeycomb, the cubes being approximately 2½ centimeters per edge;

cross sections of alumina tubes 4 centimeters in diameter by approximately 3 centimeters in height; and 1 centimeter diameter alumina balls similar to those in Example 1.

The etched aluminum materials were rinsed in distilled water and stored in methyl alcohol. Each was then coated with titanium for four hours at approximately 1000° C. under an argon atmosphere scrubbed of oxygen by passage over hot titanium in a bath comprising 796 grams of KCl, 640 grams of NaCl, 59 grams of CaCl, and 65 grams of $TiH_2$.

Following cooling, the excess salt was washed from the alumina objects using hot water and the objects were stored under methyl alcohol. Each of the objects was then boridized by packing the materials in amorphous boron and heating to approximately 1000° C. in well known manner for approximately 48 hours again under an oxygen free argon environment.

These treated cubes, tube sections and balls were then ready for electrolytic cell testing. Each of the honeycomb cubes and balls was individually placed within one of the treated alumina tube sections. A larger diameter untreated alumina section also three centimeters in height was then placed around the treated alumina tube section. Both tube sections were then filled with aluminum beads. $Al_2O_3$ powder was packed around the outside of the untreated tube section to contain aluminum during melting. The aluminum beads were then melted so as to encapsulate the honeycomb cube and the ring or the ball and its containing ring. The untreated large diameter aluminum tube section was broken away after cooling.

The honeycombs and balls surrounded by the treated alumina tube sections and encased in aluminum were subjected to 10 hour polarization tests. Each honeycomb or ball in its alumina tube section was placed on a carbon disc 6 centimeters in diameter by 0.7 centimeters thick resting on a 6 centimeter diameter alumina pallet positioned in the bottom of a 750 milliliter alumina crucible. A molybdenum rod encased in boron nitride was employed as a cathodic current feeder connecting to the carbon disc and through the alumina pallet to the cathode side of a source of electrical current. The cell was completed by positioning a carbon cylinder 3 centimeters in diameter and 3½ centimeters in length into the crucible for employ as an anode. The cell was charged with 600 grams of 10 percent alumina in cryolite. 4.81 amperes were passed between anode and cathode for 10 hours. 3 centimeters of molten aluminum was maintained in the cell so that the honeycombs or balls remained immersed at all times.

After cooling, each aluminum cathode was disassembled and the coated alumina honeycomb or ball was examined. For each cube or ball, the surrounding alumina tube section had fractured. Examination of the honeycomb revealed that the aluminum surrounding the honeycomb had protected the alumina honeycomb from attack while under polarization.

During the tests 4.8 grams of anode was consumed, the cell voltage was approximately 2.47 volts, and the spacing between the anode and the aluminum cryolite interface within the cell was 2.5 to 2.7 centimeters.

EXAMPLE 4

Example 3 was repeated except that provision was made for draining aluminum from the crucible as it formed so that the honeycomb or balls were bathed in cryolite, the carbon disc was replaced with a titanium diboride disc of equal dimension, and the honeycomb or balls were placed directly on the titanium diboride disc without benefit of the surrounding treated tube section. The honeycomb or balls were each encased in aluminum upon insertion into the cell. That aluminum melted upon cell start-up and was withdrawn from the crucible. The cryolite charged to the cell was electrolyzed to produce molten aluminum under electrolysis conditions identical to Example 3 except that the anode was maintained at approximately 2.5 centimeters distance from upper portions of the honeycomb or ball as arranged in the crucible cell.

After ten hours each cell was cooled and each honeycomb or ball was removed for examination. These objects, notwithstanding their direct contact with molten cryolite during electrolysis, were found to have a 100 to 500 micron film of aluminum upon all surfaces. The alumina substrates of each honeycomb or ball were not attacked.

EXAMPLE 5

A cylindrical solid section of $AlB_{12}$ was split longitudinally to yield a solid half cylinder. The half cylinder was degreased with propanol. The degreased half of the cylinder was immersed in a mixture of 20.36 grams KCl, 16.52 grams NaCl, 1.52 grams $CaCl_2$, and 2 grams of titanium hydride at approximately 1000° C. under an argon inerted atmosphere scrubbed of oxygen by passage over hot titanium. Immersion was continued for four hours. The half cylinder was then boridized in a manner identical to that of Example 1. Upon inspection, a 15 micron coating of titanium diboride was found to be present on the surface of the half cylinder.

The half cylinder was placed in a 750 milliliter alumina crucible, containing a titanium diboride ring filled with aluminum. The half cylinder was inserted into the ring so that a portion of the half cylinder protruded above the aluminum contained within the titanium diboride ring. The balance of the crucible was filled with cryolite. The crucible was heated to 1000° C. for 2 hours. After 2 hours the treated half cylinder was found to be coated uniformly with aluminum, even those portions of the titanium diboride coated half cylinder which had extended into cryolite floating atop molten aluminum contained in the $TiB_2$ ring.

EXAMPLE 6

Example 5 was repeated using a half cylinder of BN with essentially identical results.

While a preferred embodiment of the invention has been shown and described in detail, it should be apparent that various modifications, alterations, or adjustments may be made from the embodiment as shown without departing from the scope of the claims following.

What is claimed is:

1. In an electrolytic process for electrowinning aluminum from aluminum oxide in solution in a molten cryolite electrolyte floating on a pool of molten aluminum, the improvement which comprises providing therein in contact with said molten aluminum at least one structural or functional component which is formed from a normally aluminum non-wettable refractory material chosen from the group consisting of alumina, aluminum nitride, AlON, SiAlON, boron nitride, silicon nitride, silicon carbides, aluminum borides, alkaline earth metal zirconates and aluminates and their mixtures and having deposited on the surface thereof a thin coating containing both a metallic element wettable by aluminum and chosen from the group consisting of titanium, zirconium and hafnium and, as a solubility suppressor for said metallic element, boron, and separately providing in said molten aluminum pool nearly saturating concentrations of said metallic element and boron.

2. The improved process of claim 1 wherein the metallic element is zirconium.

3. The improved process of claim 1 wherein the metallic element is hafnium.

4. The improved process of claim 1 wherein the metallic element is titanium.

5. The improved process of claim 1 wherein the coating is between about 5 angstroms and about 100 microns in thickness.

6. An economical method of producing structural or functional components for use in an electrolytic cell for winning aluminum from a molten cryolite bath containing aluminum oxide, comprising:

(a) fabricating a structural or functional component of desired configuration from an aluminum non-wettable, refractory material chosen from the group consisting of alumina, aluminum nitride, AlON, SiAlON, boron nitride, silicon nitride, silicon carbides, aluminum borides, alkali earth metal zirconates and aluminates, and their mixtures;

(b) applying to surfaces of the fabricated component from step (a) a thin coating containing both a metallic wetting agent, such as Zirconium or Titanium, and as a solubility suppressor, Boron said coating ranging in thickness between about 5 Angstroms and 100 microns.

7. The improved method of claim 6, wherein the coating is continuous.

8. The improved method of claim 6, wherein the substrate is alumina.

9. The method of claim 6 wherein said metallic wetting agent is titanium.

10. The method of claim 6 wherein said metallic wetting agent is zirconium.

11. The method of claim 6, 9, 10, 7 or 8 wherein, in step (b), the metallic wetting agent and the boron are applied in the form of oxides and the oxide coated component thus produced is subsequently brought into contact with molten aluminum causing a reaction with said oxides to form borides of said metallic wetting agent.

12. In a method of operating an electrolytic cell to produce aluminum by electrolyzing a molten cryolite electrolyte containing aluminum oxide by means of direct current passing between anode surfaces immersed in said cryolite electrolytes and cathode surfaces associated with a pool of molten aluminum underneath said cryolite electrolyte, the improvement comprising utilizing, in the region of said cell below the cryolite electrolyte, structural parts and/or functional components formed from a normally aluminum non-wettable refractory substrate which has a thin coating formed thereon containing a metallic wetting agent such as Ti or Zr and as a solubility suppressor, boron, and independently providing said wetting agent and boron to said molten aluminum pool in substantially saturating amounts.

13. The improvement of claim 12 wherein the coating is between about 5 angstroms and 100 microns in thickness.

14. The improvement of claim 13 wherein the coating is continuous.

15. The improved method of claim 12 wherein said thin coating is titanium boride.

16. The improved method of claim 12 wherein said thin coating is zirconium boride.

17. An economical, molten aluminum-wettable component for use in an electrolytic cell for winning aluminum from a molten cryolite bath containing aluminum oxide, comprising an aluminum non-wettable substrate of desired configuration fabricated from a refractory compound chosen from the group consisting of alumina, aluminum nitride, AlON, SiAlON, boron nitride, silicon carbides, silicon nitride, aluminum borides, alkaline earth metal zirconates and aluminates and mixtures thereof, which substrate has an adherent surface coating of titanium, zirconium or hafnium borides between about 5 Angstroms and 100 microns in thickness.

18. The component of claim 17 wherein the coating is continuous.

19. The component of claim 17, the substrate material being alumina.

20. The component of claim 17, the coating being $TiB_2$.

21. The molten aluminum-wettable component of claims 17, 18, 19 or 20 wherein said coating is between 10 Angstroms and 100 microns in thickness.

22. In an electrolytic process for electrowinning aluminum metal from aluminum oxide in solution in a molten cryolite electrolyte floating on a pool of molten aluminum, the improvement which comprises providing therein in contact with said molten aluminum at least one structural or functional component which is formed from a normally aluminum non-wettable refractory ceramic material having deposited on the surface thereof a thin coating containing titanium and boron, and separately providing in said molten aluminum pool nearly saturating concentrations of titanium and boron.

23. The improved process of claim 22, the coating being continuous.

24. The improved process of claim 22 wherein said coating is between about 5 angstroms and about 100 microns in thickness.

25. The improved process of claim 22 wherein said refractory is predominantly alumina.

26. The improved method of claim 12 wherein the functional components utilized comprise a packed bed of loose elements having the thin coating specified and located in the pool of molten aluminum.

* * * * *